US007377325B2

(12) United States Patent
Trinder et al.

(10) Patent No.: US 7,377,325 B2
(45) Date of Patent: May 27, 2008

(54) CENTRALISER

(75) Inventors: Duncan James Trinder, Inverurie (GB); Neil Andrew Abercrombie Simpson, Aberdeen (GB); Alexander Craig Mackay, Banchory (GB)

(73) Assignee: Weatherford/Lamb, Inc., Houston, TX (US)

( * ) Notice: Subject to any disclaimer, the term of this patent is extended or adjusted under 35 U.S.C. 154(b) by 298 days.

(21) Appl. No.: 10/877,319

(22) Filed: Jun. 24, 2004

(65) Prior Publication Data

US 2005/0183864 A1 Aug. 25, 2005

(30) Foreign Application Priority Data

Jun. 28, 2003 (GB) ..... 0315144.6

(51) Int. Cl.
*E21B 17/10* (2006.01)

(52) U.S. Cl. ..... 166/382; 166/241.6

(58) Field of Classification Search ..... 166/241.1, 166/382, 241.6, 241.7, 206, 213; 175/325.1, 175/325.2, 325.3
See application file for complete search history.

(56) References Cited

U.S. PATENT DOCUMENTS

| | | | | |
|---|---|---|---|---|
| 2,228,649 | A * | 1/1941 | Welles | 166/172 |
| 3,312,285 | A * | 4/1967 | Solum | 166/241.6 |
| 3,379,258 | A * | 4/1968 | Turbyfill | 166/241.7 |
| 6,725,939 | B2 * | 4/2004 | Richard | 166/384 |

FOREIGN PATENT DOCUMENTS

| | | |
|---|---|---|
| GB | 2148985 | 6/1985 |
| GB | 2405430 | 3/2005 |
| WO | WO 97/17524 | 5/1997 |
| WO | WO 00/37766 | 6/2000 |
| WO | WO 01/98623 | 12/2001 |
| WO | WO 03/006789 | 1/2003 |
| WO | WO 03/012246 | 2/2003 |
| WO | WO 03/078789 | 9/2003 |

OTHER PUBLICATIONS

GB Search Report dated Nov. 3, 2003 from GB Application No. 0315144.6.
U.K. Search Report, Application No. GB0414033.1, dated Aug. 12, 2004.
GB Search Report, Application No. 0414033.1, dated Jul. 11, 2006.

* cited by examiner

*Primary Examiner*—Kenneth Thompson
(74) *Attorney, Agent, or Firm*—Patterson & Sheridan, L.L.P.

(57) ABSTRACT

There is disclosed an expandable centraliser for locating a body within a borehole, and a method of centralising tubing in a borehole.

In an embodiment of the invention, an expandable centraliser (10) is disclosed, the centraliser (10) comprising a deformable body (12), and at least one abutment portion in the form of a shoulder (14) on the body (12), the shoulder (14) adapted to be urged radially outwardly on deformation of the body (12), to centralise tubing (28) coupled to the centraliser (10) within a borehole (15).

32 Claims, 5 Drawing Sheets

CENTRALISER

CROSS-REFERENCE TO RELATED APPLICATIONS

This application claims benefit of Great Britain patent application serial number GB 0315144.6, filed Jun. 28, 2003, which is herein incorporated by reference.

BACKGROUND OF THE INVENTION

1. Field of the Invention

The present invention relates to a centraliser. In particular, but not exclusively, the present invention relates to an expandable centraliser for locating a body within a borehole.

2. Description of the Related Art

In the oil and gas exploration and production industry, a borehole is drilled from surface to a desired depth and sections of tubular casing are coupled together, run into the borehole and cemented in position.

Typically, the well is drilled to a first depth and certain physical parameters checked, before the first section of well is lined with a casing string which extends from a wellhead and which is made up from sections of tubular casing coupled together. The well is then drilled to a greater depth, and a smaller diameter casing string is located extending from the wellhead within the first casing string and the unlined well section, and cemented in place. This procedure is continued until a final section of the borehole is lined with a tubular liner string extending from the bottom of the deepest casing string, to gain access to hydrocarbon bearing formations.

The casing and liner strings must be centralised within the open borehole to allow fluid circulation between the outer surface of the tubing string and the borehole, such that cement used to seal and fix the string into position can flow up the annulus defined between the borehole wall and the tubing string. This is achieved by locating centralisers at intervals along the strings.

Current centralisers include solid and sprung/wicker centralisers. Solid centralisers define a section of increased outer diameter on the respective tubing string and typically include spiral (helical) or straight (axial) bypass slots for fluid circulation. Sprung or wicker centralises include sprung wicker arms or strips spaced around the outer diameter of the tubing.

Recent developments in the industry include the use of expandable tubing, which offers a number of advantages over conventional downhole tubing. Proposals include running expandable tubing into a borehole in an unexpanded configuration and then expanding the tubing downhole. However, conventional centralisers cannot be expanded and cannot be used with expandable tubing.

It is amongst the objects of embodiments of the present invention to obviate or mitigate at least one of the foregoing disadvantages.

SUMMARY OF THE INVENTION

According to a first aspect of the present invention, there is provided an expandable centraliser comprising:

a deformable body; and at least one abutment portion on the body, the abutment portion adapted to be urged radially outwardly on deformation of the body.

It will be understood that centralisers include apparatus such as tubing centralisers; stabilisers, which are typically used for centralising a rotating body such as a drill string; and anchors, such as torque anchors, which resist rotation within a borehole.

The centraliser may initially describe an outer first diameter and may be urged outwardly to describe a larger, second diameter on deformation of the body.

The centraliser may be adapted to be located in a borehole of a well and the body deformed to urge the abutment portion outwardly towards a wall of the borehole. It will be understood that, following movement of the abutment portion outwardly in this fashion, one or more gaps are defined between an outer wall of the body and the borehole wall. Thus fluid flow past the centraliser through the gap is possible even after deformation. This allows, inter alia, circulation of cement for cementing a string of tubing carrying the centraliser in place.

Preferably, the centraliser comprises a plurality of circumferentially spaced abutment portions. Preferably, the abutment portion is provided on the body at a location intermediate opposite ends of the body.

The centraliser may be adapted to be coupled to a body to be expanded.

The invention provides an expandable centraliser which can be used to locate a body within a borehole, for example, to centralise the body within the borehole. The body may comprise a casing, liner or drill tubing or any other downhole tubing or body such as a downhole tool or part of a downhole tool. The invention also provides an expandable centraliser which can be run into a borehole in an unexpanded configuration, to facilitate location of the centraliser at a desired position within a borehole prior to expansion. The centraliser may be deformable to an expanded configuration. In the unexpanded configuration, the abutment portion may define the first outer diameter and in the expanded configuration, the abutment portion may describe the larger, second diameter. In the unexpanded configuration, the abutment portion may describe a first diameter less than, or alternatively, equal to or greater than a diameter described by a remainder of the body.

The body may be generally tubular and may include a profiled portion of non-uniform wall shape and/or diameter. The body may include at least one groove, channel, slot, depression, fold, crinkle, flute or the like, which may extend axially, circumferentially or helically with respect to the body, or an area of reduced wall thickness. The groove or the like of the profiled portion may be extended circumferentially (stretched) on deformation of the body and may therefore open out.

The profiled portion may extend along part of a length of the body, or along substantially an entire length of the body, save for any coupling such as male/female threaded portions on the body serving for coupling the body to, for example, a tubing string.

The centraliser may comprise a stabiliser. It will be understood by those of skill in the art that a stabiliser is a tool used for centralising a rotating tubular or the like in a borehole, for example, a rotary drill string.

The profiled portion may describe an inner diameter smaller than an inner diameter described by an unprofiled portion of the body, such as a longitudinally adjacent part of the body or by tubing coupled to the stabiliser. The abutment portion may extend from the profiled portion.

The abutment portion may be adapted to describe the larger, second diameter and may define an upset on the body when the body is deformed.

The abutment portion may be integral with the body. Thus, the body may be of a wall thickness greater in the region of the abutment portion than in a remainder of the body.

Alternatively, the abutment portion may comprise a separate abutment member adapted to be coupled to the body, for example, by welding or using a suitable fixing such as pins, screws, bolts or the like, or a combination thereof.

The downhole tubular may comprise a plurality of circumferentially spaced abutment portions and grooves or the like, each abutment portion extending between an adjacent pair of grooves or from a respective groove.

The centraliser may be of the type suitable for centralising a non-rotating body. The centraliser body, and thus the abutment portion, may be adapted to be moveably mounted with respect to a body to be centralised and may be rotatable. This ensures that, on deformation of the body, the abutment portion can rotate with respect to the body, preventing undesired deformation. Thus, where a rotary expansion tool is used for deforming the body, such as the Applicant's tool disclosed in International patent publication No. WO00/37766, there is no undesired deformation of the abutment portion due to the rotational forces applied to the body. It will be understood that alternative tools and methods for expanding tubing may be employed, such as an expansion cone or mandrel.

The abutment portion may comprise an abutment member such as an arm or finger, which may extend generally radially outwardly from the body. The abutment portion may comprise a sprung arm.

The body may comprise two or more spaced sleeves, collars, rings or tubes coupled together, for example, by the abutment portion. Alternatively, the body may comprise a single sleeve, collar, ring or tube with the abutment portion extending therefrom. The body collar or the like may define the profiled portion.

In a further alternative, the expandable centraliser may comprise an anchor. The anchor may be used for restraining a body to which the downhole tubular is coupled against rotation and/or axial movement within a borehole or other body.

The abutment portion may be movable between a retracted position and an extended position on deformation of the body. In the retracted position, the abutment portion may be in a stressed configuration and in the extended position, the abutment portion may be in a substantially or relatively unstressed or relaxed configuration. The abutment portion may be resilient, for example, sprung or otherwise biased for movement towards the extended position on deformation of the body. The abutment portion may be formed in a wall of the tubular body.

The anchor may comprise a torque anchor. A torque anchor resists rotation to restrain a body coupled to the anchor against rotation. The abutment portion may be disposed at an acute angle with respect to an outer surface of the tubular body when in the extended position, for engaging, for example, a borehole wall or the wall of tubing in which the downhole tubular is located. The abutment portion may be directed in a generally clockwise or anticlockwise direction, for resisting rotation of the tubular body in at least one direction. Where the downhole tubular comprises a plurality of abutment portions, the abutment portions may each be directed in a common direction. Also, each abutment portion may be at a common acute angle. Alternatively, a selected one or more of the abutment portions may be directed in a different direction and/or disposed at a different acute angle with respect to one or more other abutment portions. Thus, for example, alternate abutment portions may be directed in generally opposite directions such that once expanded, the body may be restrained against rotation in both a clockwise and anticlockwise direction.

The anchor may alternatively comprise a wicker anchor. A wicker anchor resists movement in a longitudinal direction. The abutment portion may be directed in a generally axial direction for resisting axial movement of the tubular body when the abutment portion is in the extended configuration.

In a further alternative, the abutment portion may be directed generally in both a circumferential and an axial direction, or the body may include a plurality of abutment portions, with at least one directed generally circumferentially and at least one generally axially. Accordingly, the downhole tubular may resist both rotational and axial movement, when the body is deformed.

The abutment portion may be restrained in the retracted position by the body and may be restrained by a shoulder, face or ledge formed in a wall of the tubular body. In embodiments of the invention, the abutment portion may be located adjacent or in an opening in a wall of the body and a side wall of the opening may abut a face of the abutment portion for restraining the abutment portion in the retracted position, before the body is deformed. When the body is deformed, the opening may extend circumferentially, such that the abutment portion moves out of abutment with the opening side wall and is urged towards the extended position. The opening may alternatively be provided in an expandable restraining body such as an outer sleeve mounted on the body.

According to a second aspect of the present invention, there is provided a method of centralising tubing in a borehole, the method comprising the steps of:

coupling a centraliser to the tubing;

locating the tubing in the borehole; and deforming a body of the centraliser to urge an abutment portion on the body radially outwardly.

BRIEF DESCRIPTION OF THE DRAWINGS

Embodiments of the present invention will now be described, by way of example only, with reference to the accompanying drawings, in which.

DETAILED DESCRIPTION OF DRAWINGS

Figure 1:
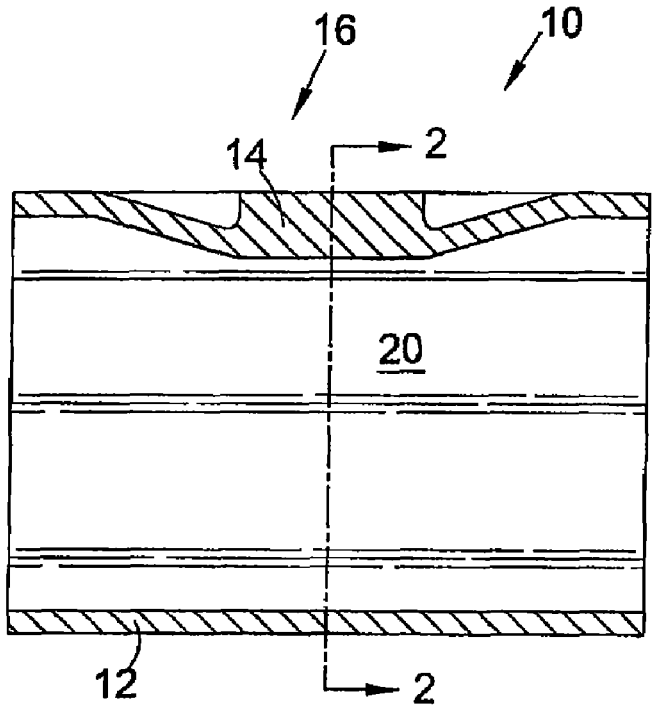
FIG. 1 is a longitudinal sectional view of an expandable centraliser in accordance with an embodiment of the present invention, shown in an unexpanded configuration.
Figure 2:
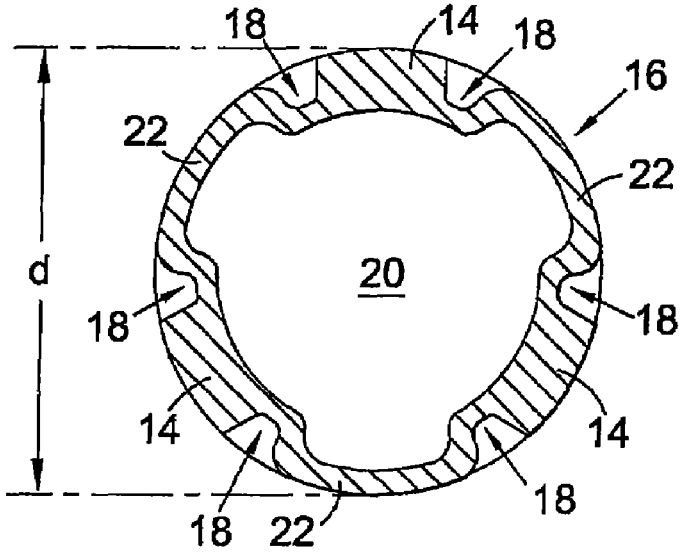
FIG. 2 is a view of the expandable centraliser shown in FIG. 1, taken along line 2-2 of FIG. 1.

Referring firstly to FIG. 1, there is shown a longitudinal sectional view of an expandable centraliser in accordance with an embodiment of the present invention, the centraliser indicated generally by reference numeral 10. FIG. 2 is a view of the centraliser 10 taken along line 2-2 of FIG. 1.

Figure 2A:
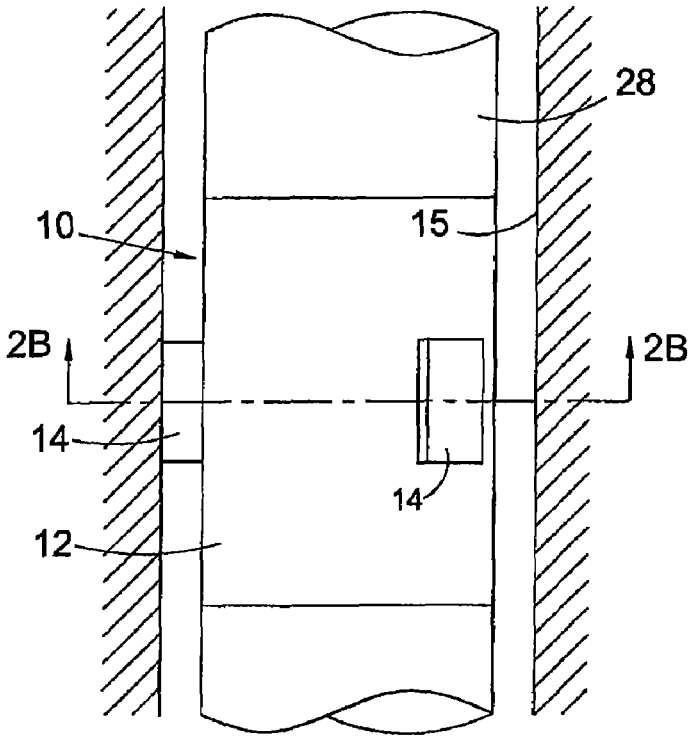
FIG. 2A is a view of the expandable centraliser of FIG. 1, shown located in a borehole and in an expanded configuration.
Figure 2B:
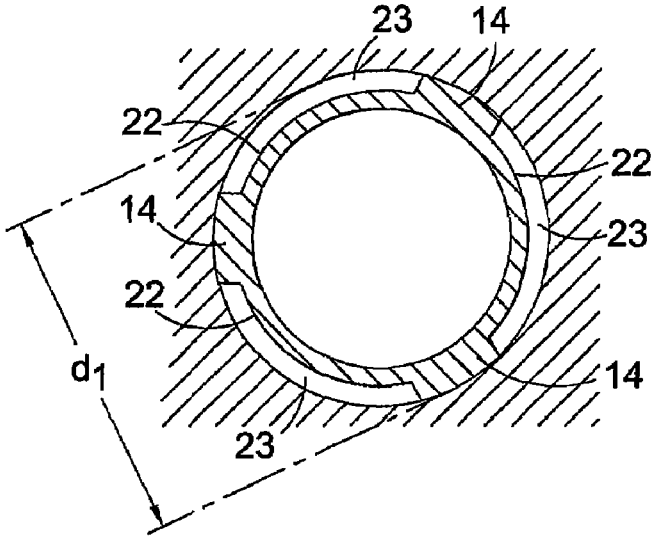
FIG. 2B is a view of the expandable centraliser taken along line 2B-2B of FIG. 2A.

The centraliser 10 is shown in FIGS. I and 2 in an unexpanded configuration, and includes a deformable body 12 and at least one abutment portion, in this embodiment, four abutment shoulders 14, which are shown more clearly in FIG. 2. The shoulders 14 initially describe a first diameter d and, on deformation of the body 12, the shoulders are urged radially outwardly to describe a second, larger diameter d1, as shown in FIG. 2A, which is a view of the centraliser 10 shown located in a borehole 15 in an expanded configuration, and FIG. 2B, which is a view of the centraliser 10 taken along line 2B-2B of FIG. 2A.

In more detail, the centraliser 10 takes the form of a stabiliser used to centralise a string of tubing within a borehole 15 of an oil or gas well. The stabiliser 10 may, for example, be used to centralise rotary tubing such as a drill string, but has a particular utility with an expandable liner 28. This is because the centraliser helps to prevent differential sticking (where the liner becomes stuck to the borehole wall due to a large differential pressure between fluid such as drilling fluid in the borehole around the liner and a relatively low pressure formation). The centraliser also facilitates flow of cement around the liner between the shoulders 14, when expanded, to cement the liner in position, as will be described below. The stabiliser 10 is expandable for running into the borehole 15 in the unexpanded configuration on conventional or expandable tubing. The stabiliser 10 is then expanded in the downhole environment. As will be understood by persons skilled in the art, the use of expandable tubulars in the downhole environment offers numerous advantages over conventional, unexpandable tubulars. These include the ability to create a "mono-bore" well.

The stabiliser 10 is provided as a short sub adapted to be coupled at opposite ends to sections of tubing and where coupled to expandable tubing, the stabiliser may be coupled through expandable threaded connections.

The abutment shoulders 14 of the stabiliser are formed on a profiled portion 16 of the body 12 and are an integral part of the body. The profiled portion 16 is shaped such that the abutment shoulders 14 are initially in a position where they conform with the outer diameter of the body 12, which is equal to the diameter d described by the shoulders 14, such that the shoulders do not initially define an upset. This facilitates running of the stabiliser 10 and thus of a string of tubing carrying the stabiliser, into the borehole 15. The profiled portion 16 includes a number of axial grooves 18 which extend part way along the length of the body 12, as shown in FIG. 1. The abutment shoulders 14 are formed between circumferentially adjacent pairs of the grooves 18, and extend into the stabiliser bore 20. The inner profile of the stabiliser 10 matches the outer profile, except the wall thickness of the tubular body 12 in the region of the abutment shoulders 14 is relatively larger than that of the grooves 18 and the wall sections 22.

Following positioning of the stabiliser 10 at a desired location, the stabiliser is deformed and expanded. The stabiliser 10 and, optionally, the expandable tubing sections coupled to the stabiliser, are typically deformed using a rotary expansion tool, such as that disclosed in the Applicant's International patent publication No. WO 00/37766. Alternatively, any other suitable tool, such as an expansion cone or mandrel, may be employed. On deformation, the abutment shoulders 14 are urged radially outwardly such that the shoulders become upstanding, extending from the body 12 and describing the larger second diameter. Wall sections 22 of the body 12, the remainder of the body and the tubing sections coupled to the stabiliser 10 may also optionally be expanded. Expansion smoothes out the internal bore 20 of the body in the region of the profiled portion 16 to a circular profile. Accordingly, the stabiliser 10 may then be further expanded to describe an increased diameter, if desired.

The abutment shoulders 14 then define an upset on the body 12 for stabilising and centralising the tubing string within the borehole 15. As the abutment shoulders 14 are circumferentially spaced around the tubular body 12, flow paths or channels 23 (FIG. 2B) are defined between the shoulders 14 in the region of the wall sections 22. This allows fluid flow through the channels 23, for example, for circulation of drilling fluids or cement. It will be understood that the expanded profile of the stabiliser 10 (FIG. 2A/B) is formed using the material forming the reduced internal diameter d such that, on expansion, the internal and external profiles are straightened to form the final stabiliser profile.

Figure 3:
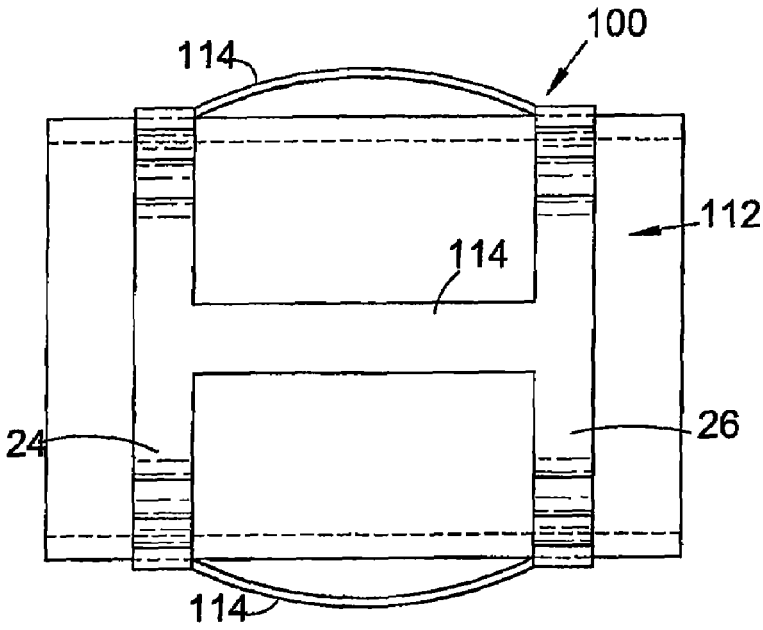
FIG. 3 is a view of an expandable centraliser in accordance with an alternative embodiment of the present invention.
Figure 4:
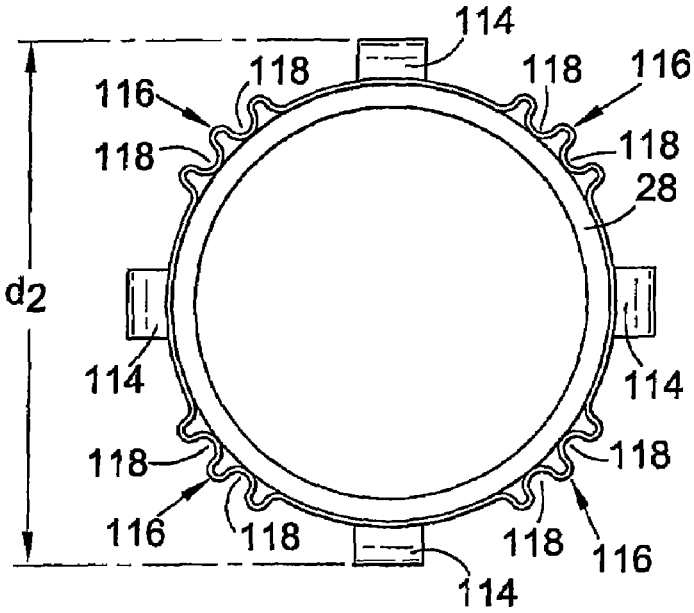
FIG. 4 is an end view of the expandable centraliser shown in FIG. 3.

Turning now to FIG. 3, there is shown a view of an expandable centraliser in accordance with an alternative embodiment of the present invention, the expandable centraliser indicated generally by reference numeral 100. Like components of the centraliser 100 with the stabiliser 10 of FIGS. 1 and 2 share the same reference numerals incremented by 100. FIG. 4 is an end view of the centraliser.

The centraliser 100 includes a deformable body 112 having first and second axially spaced ring-shaped collars 24, 26. The centraliser 100 also includes at least one abutment portion, in this embodiment, four circumferentially spaced abutment or wicker arms 114 which are sprung and couple the collars 24, 26 together. The collars 24, 26 are rotatably mounted on an expandable tubular 28, such as a section of expandable casing, only part of which is shown in FIGS. 3 and 4.

Each of the collars 24, 26 include axially profiled portions 116 which are generally corrugated and circumferentially spaced around the collars, each portion 116 including a number of folds 118. The abutment arms 114 initially describe a first diameter d2 prior to deformation of the expandable casing section. On deformation and expansion of the tubing section 28, for example, using a rotary expansion tool or expansion cone or mandrel, any resultant rotation of the casing section is allowed for by relative rotation between the casing section and the collars 24, 26. This avoids damage to the abutment arms 114 and maintains their relative circumferential positioning in the borehole.

The abutment arms 114 are thus urged substantially radially outwardly, whilst the profiled portions 116 of the collars 24 and 26 stretch and straighten out, such that the collars extend in a circumferential direction. Accordingly, even following expansion, the centraliser 100 acts to centralise a tubing string within the borehole 15, ensuring that the string lies centrally within the borehole for subsequent cementation.

The centraliser 100 has a particular utility when mounted on an expandable tubing such as an expandable casing or liner 28, to stand the liner off from the borehole wall during run-in and to maintain the liner centrally in the borehole.

Figure 5:
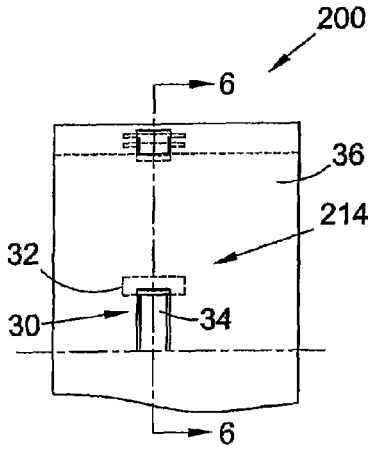
FIG. 5 is an enlarged view of part of an expandable centraliser in accordance with a further alternative embodiment of the present invention, shown in an unexpanded configuration.
Figure 6:
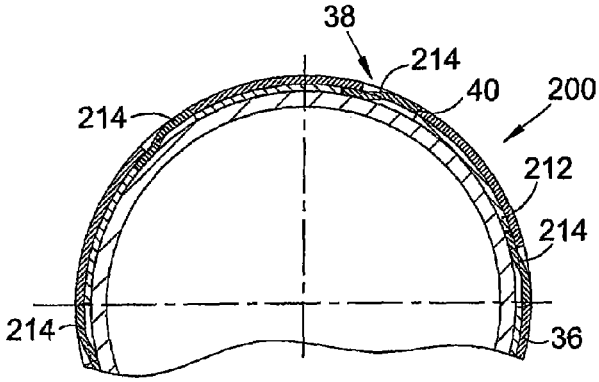
FIG. 6 is a cross-sectional view of the part of the expandable centraliser shown in FIG. 5, taken along line 6-6 of FIG. 5.

Turning now to FIG. 5, there is shown an enlarged view of part of an expandable centraliser in accordance with a further alternative embodiment of the present invention, the centraliser indicated generally by reference numeral 200, and shown in FIG. 5 in an unexpanded configuration. FIG. 6 is a view of the part of the centraliser 200 taken along line 6-6 of FIG. 5. The centraliser 200 comprises an anchor, in particular a torque anchor and like components of the torque anchor 200 with the stabiliser 10 of FIGS. 1 and 2 share the same reference numerals, incremented by 200.

Figure 7:
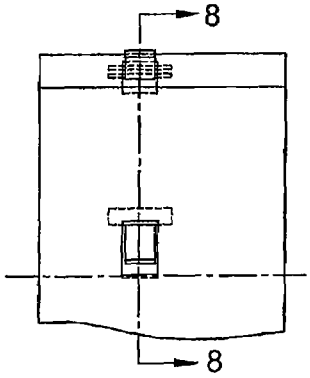
FIG. 7 is a view of the part of the expandable centraliser of FIG. 5, shown in an expanded configuration.
Figure 8:
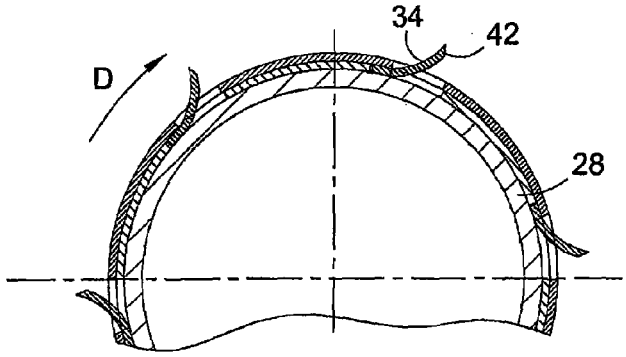
FIG. 8 is a view of the part of the expandable centraliser shown in FIG. 7, taken take along line 8-8 of FIG. 7.

The torque anchor 200 includes a body 212 which is deformable from an unexpanded configuration shown in FIGS. 5 and 6, to an expanded configuration shown in FIGS. 7 and 8, which correspond to FIGS. 5 and 6, respectively. The torque anchor 200 also includes at least one abutment portion, in this embodiment, six abutment members (four shown in FIGS. 6 and 8) comprising fingers 214. The abutment fingers 214 are restrained in a retracted position when the body is in the unexpanded configuration (FIGS. 5 and 6) and are moved towards an extended position, where they extend from the tubular body 212, when the body is deformed and expanded (FIGS. 7 and 8).

In more detail, the tubular body 212 includes six equally spaced T-shaped apertures 30 in a wall of the body, and each finger 214 includes a body coupling portion 32 and a free portion 34. The coupling portion 32 is coupled to the tubular body 212 in the T-shaped aperture 30, whilst the free portion 34 is moveable on expansion of the body.

Each of the abutment fingers 214 are sprung such that, in the retracted position of FIGS. 5 and 6, the finger free portions 34 are restrained and thus in a stressed configuration. The torque anchor 200 includes a separate outer expandable sleeve 36 around the expandable body 212, which includes apertures 38, and the sleeve 36 is rotationally oriented such that the apertures 38 are aligned with the free finger portions 34. The apertures 38 include angled faces 40 which, in the unexpanded configuration, abut end faces 42 of the finger free portions 34, to restrain the abutment fingers 214 in their retracted, stressed positions.

The torque anchor 200 is mounted on an expandable casing section 28 and, on expansion of the casing section, the tubular body 212 and outer sleeve 36 are diametrically expanded. This expansion circumferentially extends the apertures 38 in the outer sleeve 36, such that the angled faces 40 of the outer sleeve move out of contact with the end faces 42 of the finger free portions 34. The finger free portions 34, which are no longer restrained, then spring outwardly to the extended position of FIGS. 7 and 8, to engage the borehole wall and rotationally anchor the torque anchor 200, and thus the casing section 28, against rotation in the direction of the arrow D shown in FIG. 8. It will be understood that, when the finger free portions 34 are released, they may not move completely to the fully extended position shown through contact with the borehole wall. However, there will be a sufficient movement for the end faces 42 to engage the borehole wall, thus preventing rotation.

The anchor 200 has a utility where it is desired to lock an expandable tubing, such as a liner 28, against rotational/axial movement. In particular, this may be of use where it is desired to locate a 'discrete clad' such as a patch in a casing or liner, which is not tied back to a wellhead or higher casing string.

A further potential utility for anchor 200 is in the open hole environment, where the anchor 200 may be used to prevent rotation of a tubing such as a liner 28. This may be of a particular utility where a combination string of solid tubing (such as liner/casing) and slotted tubing (such as expandable sand exclusion tubing of the type disclosed in WO97/17524) is provided and it is desired to prevent the slotted tubing experiencing reaction torque when high expansion forces are applied to the solid tubing, such as when using a roller expansion tool (such as that disclosed in WO00/37766).

DETAILED DESCRIPTION OF DRAWINGS

Figure 9:
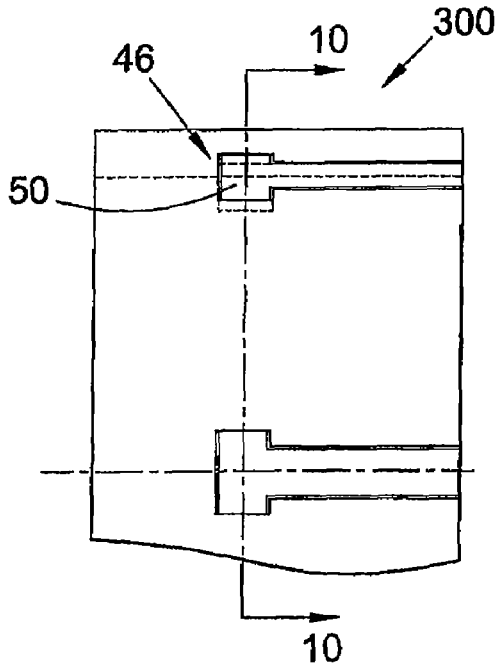
FIG. 9 is an enlarged view of part of an expandable centraliser in accordance with a still further alternative embodiment of the present invention, shown in an unexpanded configuration.
Figure 10:
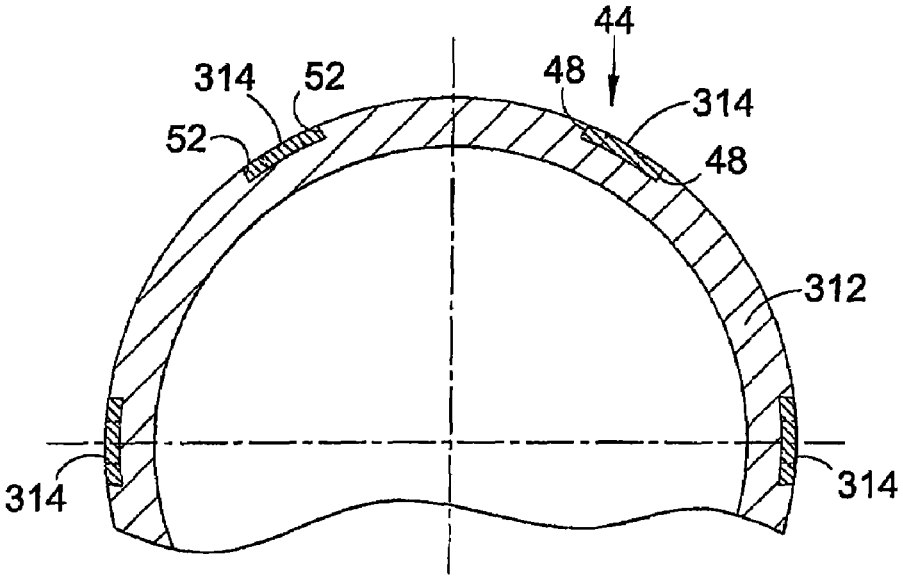
FIG. 10 is a view of the part of the expandable centraliser shown in FIG. 9, taken along line 10-10 of FIG. 9.

Turning now to FIG. 9, there is shown an enlarged view of part of an expandable centraliser in accordance with a further alternative embodiment of the present invention, the centraliser indicated generally by reference numeral 300 and shown in an unexpanded configuration. FIG. 10 is a view of the part of the centraliser 300 taken along line 10-10 of FIG. 9.

The centraliser 300 comprises an anchor in the form of an expandable wicker anchor, used for centralising, for example, a tubing string within the borehole 15 and for anchoring the string against movement in an axial direction. However, it will be appreciated that the anchor 300 has uses similar to the anchor 200 of FIGS. 5-8. Like components of the wicker anchor 300 with the stabiliser 10 of FIGS. 1 and 2 share the same reference numerals incremented by 300.

The wicker anchor 300 includes a deformable body 312 and at least one abutment portion, in this embodiment, six abutment fingers 314 circumferentially spaced around the body 312. The body 312 includes a number of recesses 44 in the body wall, one recess for each abutment finger 314. Each recess 44 is generally T-shaped and an end 46 of the recess includes an angled side wall 48. Each finger 314 is also generally T-shaped and a corresponding end part 50 of the arms include corresponding angled side faces 52 which, in the unexpanded configuration of the body 312, abut the angled side wall 48 of the recesses 44. Thus, the fingers 314 are restrained in the retracted position shown.

In a similar fashion to the anchor 200 of FIGS. 5 to 8, on expansion of the body 312, the ends 46 of the recesses 42 circumferentially extend, and the fingers 314 are sprung such that the fingers move to an extended position (not shown), centralising the tubular 312. In this position, the anchor 300 restrains tubing coupled to the anchor against axial movement within the borehole 15 through engagement between the fingers 314 and the borehole wall.

The tubular 312 may be provided as part of a string of tubing in a similar fashion to the stabiliser 10 or may be mounted around an expandable inner tubing, in a similar fashion to the anchor 200.

It will be understood by persons skilled in the art that various modifications may be made to the foregoing without departing from the spirit and scope of the present invention.

For example, the abutment shoulders 14 may initially describe a smaller or a greater diameter than a remainder of the body 12. The shoulders may therefore be initially further recessed in the body or may define an upset.

The profiled portion may include a channel, slot, depression, fold, crinkle, flute or the like and may extend circumferentially or helically with respect to the body. The profiled portion may extend along substantially an entire length of the body.

The abutment portion may comprise a separate member adapted to be coupled to the body by suitable means.

The centraliser 100 may comprise a single collar with the arms 114 extending therefrom.

The fingers 214, 314 may comprise separate members and may be sprung for movement towards the extended position. Selected one or more of the fingers 214 may extend in an opposite circumferential direction from one or more other, and one or more of the fingers 314 may extend in an opposite axial direction. A centraliser may be provided including circumferentially and axially (for example, helically) directed fingers, or fingers such as the fingers 214 and 314.

The invention claimed is:

1. An expandable centralizer comprising:

a deformable body comprising:

a collar configured to surround a tubular, the collar having at least one undulated portion formed prior to expansion of the tubular, wherein the undulated portion is configured to reform the collar to a larger diameter upon expansion of the tubular; and at least one abutment portion on the body, the abutment portion adapted to be urged radially outwardly on deformation of the body.

2. The expandable centralizer as claimed in claim 1, comprising a plurality of circumferentially spaced abutment portions.

3. The expandable centralizer as claimed in claim 1, wherein the abutment portion is provided on the body at a location intermediate opposite ends of the body.

4. The expandable centralizer as claimed in claim 1, wherein the abutment portion initially describes a first outer diameter and is adapted to be urged radially outwardly to describe a larger, second outer diameter on deformation of the body.

5. The expandable centralizer as claimed in claim 4, wherein the centralizer is movable between an unexpanded configuration in which the abutment portion describes said first diameter, and an expanded configuration in which the abutment portion describes said second diameter.

6. The expandable centralizer as claimed in claim 4, wherein the abutment portion describes a first outer diameter greater than a diameter described by a remainder of the body.

7. The expandable centralizer as claimed in claim 1, wherein the abutment portion is integral with the collar.

8. The expandable centralizer as claimed in claim 1, wherein the centralizer comprises a stabiliser.

9. The expandable centralizer as claimed in claim 8, comprising a plurality of circumferentially spaced abutment portions and profiled portions, each abutment portion extending between a pair of collars.

10. The expandable centralizer as claimed in claim 1, wherein the body is adapted to be moveably mounted with respect to a body to be centralised.

11. The expandable centralizer as claimed in claim 1, wherein the abutment portion comprises an abutment member which extends generally radially outwardly from the body.

12. The expandable centralizer as claimed in claim 11, wherein the abutment portion comprises a sprung arm.

13. The expandable centralizer as claimed in claim 1, wherein the body comprises a single collar with the abutment portion extending therefrom.

14. The expandable centralizer as claimed in claim 1, wherein the undulated portion is configured to allow the collar to increase its diameter during expansion of the tubular without breaking the collar.

15. The expandable centralizer as claimed in claim 1, wherein the undulated portion has two or more circumferential waves on the collar.

16. The expandable centralizer as claimed in claim 1, wherein the undulated portion forms a non-uniform wall shape and a non-uniform diameter of the collar.

17. The expandable centralizer of claim 1, wherein the undulated portion comprises a plurality of bends formed in the collar thereby forming one or more sinusoidal waves.

18. The expandable centralizer of claim 1, wherein the collar and the undulated portion have substantially the same thickness.

19. A method of centralizing a tubing in a borehole, the method comprising the steps of:

providing a centralizer with a collar having at least one preformed undulated portion;

coupling the centralizer to the tubing;

locating the tubing in the borehole;

deforming the collar of the centralizer and thereby deforming the undulated portion;

urging an abutment portion coupled to the collar radially outwardly; and radially expanding the tubing in order to deform the body.

20. The method of claim 19, further comprising providing a plurality of collars.

21. The method of claim 20, wherein the abutment portion is located on the plurality of collars.

22. The method of claim 21, further comprising providing a plurality of abutment portions.

23. The method of claim 19, wherein the undulated portion further comprises has a non-uniform wall shape and a non-uniform diameter.

24. The method of claim 19, further comprising forming the undulated portions by bending waves into the collar.

25. The method of claim 24, wherein the waves are substantially sinusoidal.

26. The method of claim 19, wherein the undulated portion is of substantially the same thickness as the collar.

27. A method of centralizing a tubular in a borehole, the method comprising the steps of:

forming an undulated portion on a collar of a centralizer;

coupling the centralizer with the undulated portion to the tubular, the centralizer having one or more abutment portions;

locating the tubular in the borehole;

engaging the borehole with the one or more abutment portions;

expanding the tubular and thereby deforming the undulated portion of the collar.

28. The method of claim 27, further comprising enlarging the diameter of the at least one collar by reforming the undulated portion.

29. The method of claim 27, wherein the undulated portion forms a non-uniform wall shape and a non-uniform diameter of the collar.

30. The method of claim 27, wherein forming the undulated portion on the collar further comprises bending waves into the collar.

31. The method of claim 30, wherein the waves are substantially sinusoidal.

32. An expandable centralizer, comprising: a deformable body comprising:

a pair of collars configured to surround a tubular, each of the collars having at least one profiled portion configured to reform the collars to a larger diameter upon expansion of the tubular;

a plurality of circumferentially spaced abutment portions and profiled portions on the body each abutment portion extending between the pair of collars, the abutment portions adapted to be urged radially outwardly on deformation of the body; and wherein the centralizer comprises a stabiliser.

* * * * *